United States Patent [19]

Saghafi

[11] Patent Number: 5,050,862

[45] Date of Patent: Sep. 24, 1991

[54] FOLDABLE CHILD'S WALKER

[76] Inventor: Behrouz Saghafi, 15005 Concord Dr., Woodbridge, Va. 22192

[21] Appl. No.: 504,755

[22] Filed: Apr. 23, 1990

[51] Int. Cl.[5] ..... A61H 3/00

[52] U.S. Cl. ..... 272/70.3; 297/5; 280/87.051

[58] Field of Search ..... 272/70.3, 93, DIG. 4; 297/5, 6, 7; 280/87.05, 87.051, 43.24, 649, 650

[56] References Cited

U.S. PATENT DOCUMENTS 2,282,086 5/1942 Peltier ..... 297/5

3,041,636 7/1962 Twedt ..... 297/5

FOREIGN PATENT DOCUMENTS 0184691 2/1956 Austria ..... 280/87.051

*Primary Examiner*—Stephen R. Crow

*Attorney, Agent, or Firm*—Dressler, Goldsmith, Shore, Sutker & Milnamow, Ltd.

[57] ABSTRACT

A child's walker includes pivotally connected first and second frame members which rotate with respect to one another to define an open position and a closed position. A third frame member has a tray on the front portion thereof and a rear portion which freely pivots on the first frame member. Height adjusting means are secured to the legs of the first frame member, these means supporting the legs of the second frame member when the walker is in the open position. The walker folds to the closed position for carrying and storage.

6 Claims, 2 Drawing Sheets

FIG. 1
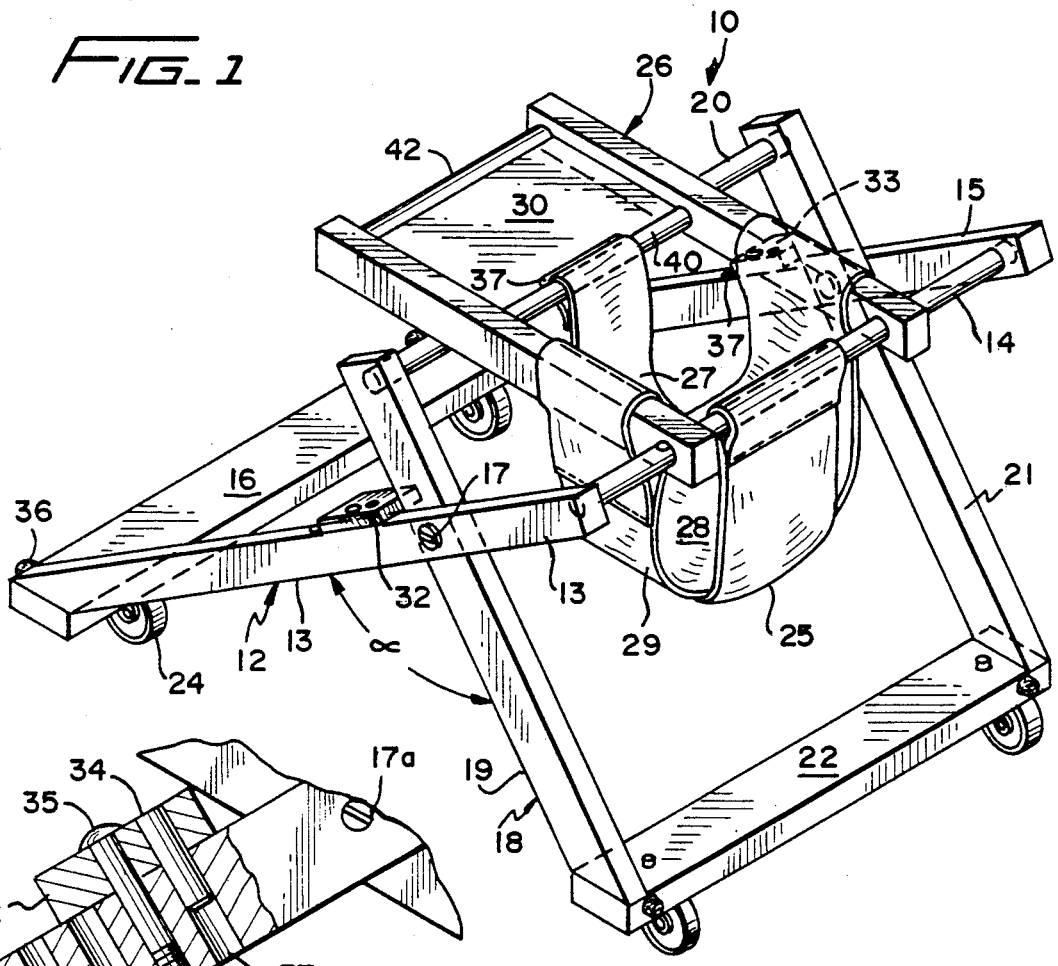
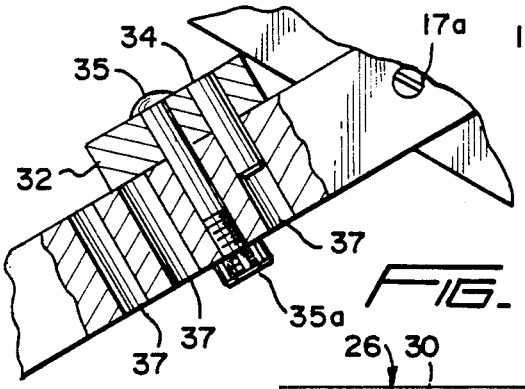
FIG. 2
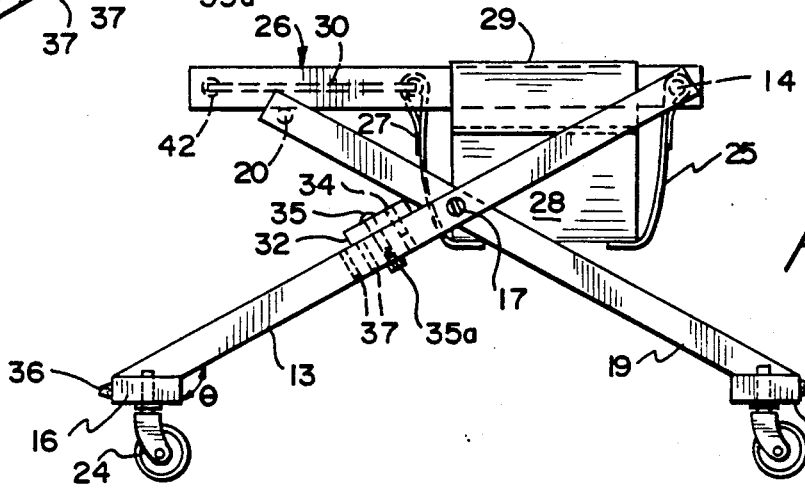
FIG. 3

FOLDABLE CHILD'S WALKER

FIELD OF THE INVENTION

The present invention relates to training devices for young children who have not yet learned to walk. The walker supports the child at a convenient height above the floor so that he can sit or exercise his legs by "walking", thus causing the device to roll around the floor.

BACKGROUND OF THE INVENTION

Many types of baby walkers have been developed over the years. Some examples are disclosed in Payne, Jr. et al. U.S. Pat. No. 4,433,869, and Cone U.S. Pat. No. 4,822,030. Foldable walkers are disclosed by Gelman Patent No. 3,009,733, Boucher et al. U.S. Pat. No. 4,045,045, Kawwai U.S. Pat. No. 4,171,132 and Ishida U.S. Pat. No. 4,019,756. None of these walkers anticipate the sturdy simplicity and easy foldability of the walker of this invention.

SUMMARY OF THE INVENTION

In accordance with this invention, there is provided a walker for a baby or very young child. The walker includes first and second frame members, each having a pair of arms connected to an upper support means and a lower support means. Wheels are secured to the lower support means. The first and second frame members are pivotally connected to rotate with respect to one another to thereby define an open position and a closed position. A third frame member has a flexible seat arranged thereon. The rear portion of the third frame member is freely pivoted to the upper support means of the first frame member, and the front portion of the third frame member, which desirably includes a tray, is disposed across the upper support means of the second frame member to lie in a generally horizontal plane when said the first and second frame members are in their open position and supported on a floor.

The walker preferably includes height adjusting means secured to both arms of the first frame member which serve to raise and lower the flexible seat relative to the floor.

The walker folds to the closed position for carrying and storage by lifting the tray and swinging it back to pivot the third frame member around the upper support means of the first support member, then grasping the upper support means to lift the walker from the floor. This action causes the first and second frame members to pivot toward each other until the walker assumes a substantially flat configuration.

The invention will be more fully understood in the light of the accompanying drawing which shows an illustrative structure in accordance with this invention.

BRIEF DESCRIPTION OF THE DRAWINGS

FIG. 1 is a top perspective view of a walker of this invention;

FIG. 2 is a detailed view of the walker's height adjusting means;

FIG. 3 is a side elevational view of the walker of FIG. 1;

DETAILED DESCRIPTION OF THE PREFERRED EMBODIMENT

Figure 4:
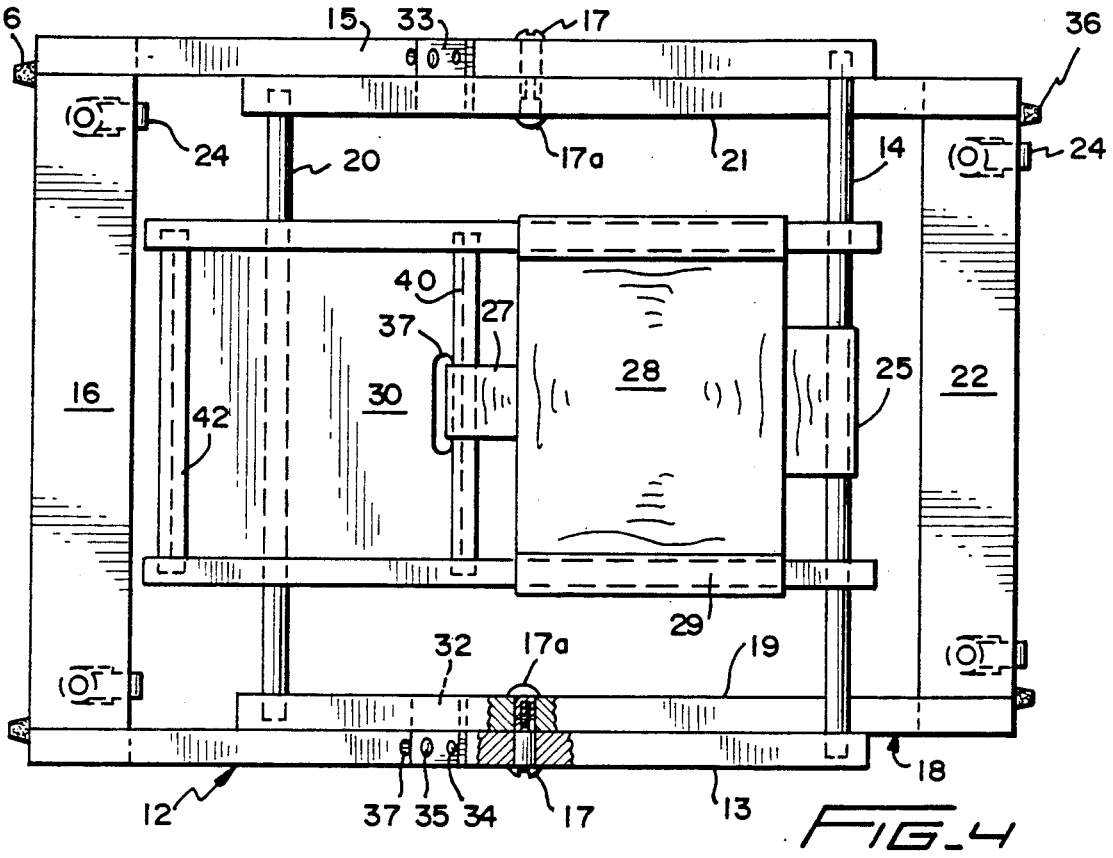
FIG. 4 is a top plan view of the walker.

With reference to FIG. 1, the child's walker 10 has a first frame member 12 which includes a pair of arms 13 and 15, an upper support means 14 and a lower support means 16, and a second frame member 18 which includes a pair of arms 19 and 21, an upper support means 20 and a lower support means 22. Lower support means 16 and 22 lower support means 22. Lower support means 16 and 22 have wheels 24 mounted thereon. First frame member 12 is pivoted to second frame member 18 by means such as a bolt 17 and nut 17*a*. The two frame members thus are rotatable with respect to one another to thereby define an open position and a closed position, the closed position being illustrated in FIG. 5. In the open position, as will be discussed more fully below, frame member 18 is supported by height adjusting means 32 and 33 arranged on frame member 12.

A third frame member 26 supports a flexible seat 28. A rear portion of frame member 26 is freely pivoted to upper support means 14 of frame member 12 and a front portion of member 26 is disposed across upper support means 20 of second frame member 18 to lie in a generally horizontal plane when frame members 12 and 18 are in their open position. A tray means 30 is arranged on the front portion of third frame member 26. As clearly shown in the drawing, tray means 30 is not secured to upper support means 20, but merely rests thereon when frame members 12 and 18 are in their open position.

Height adjusting means 32 and 33 are secured to arms 13 and 15 of frame member 12, and, in addition to supporting frame member 18 when the walker is in the open position, serve to raise or lower flexible seat 28 relative to the floor. Adjusting means 32 is illustrated in FIG. 2, adjusting means 33 being identical thereto. These means may comprise a pair of square or rectangular blocks, each including an integral pin 34 and a threaded bolt 35. Each bolt 35 is provided with a nut 35*a* to secure the adjusting means in place. A series of longitudinally spaced holes 37, preferably four in number, are arranged in arms 13 and 15. When blocks 32 and 33 are arranged on arms 13 and 15, integral pin 34 is placed in one hole 37 and bolt 35 in an adjacent hole. Nut 35*a* is then applied to bolt 35 and tightened. In this manner the blocks are prevented from swiveling out of place as they might do if secured into each block and extend outward therefrom. As seen in FIG. 2, pin 34 does not extend the full length of hole 37. Arms 19 and 21 of frame member 18 are raised or lowered as adjusting means 32 and 33 are moved from one set of holes to another, thus changing the angle $\alpha$ (alpha) as frame members 12 and 18 pivot with respect to one another. As angle $\alpha$ becomes smaller, seat 28 is raised, and as the angle becomes larger, seat 28 is lowered with respect to the floor.

Seat 28 is preferably formed of three pieces of flexible material, desirably a brightly colored waterproof fabric. All three pieces or portions are freely movable on their supports. Central portion 29 extends between the two arms of third frame member 26 and is supported by being folded over the arms and secured as by stitching. Back portion 25 is similarly supported by upper support means 14 of frame member 12 and is stitched at its lower edge to portion 29. Front portion 27, which is intended to extend between the child's legs, is narrower than portions 25 and 29, and is supported on one edge of tray 30 in the same manner as the other seat portions and, like portion 25, is stitched at its lower edge to portion 29. In order to accommodate seat portion 27, a slot 37 is provided in tray 30.

Turning now to FIG. 3, it is clearly seen that legs 13 and 19 angle upward from lower support means 16 and 22. Though not shown in this figure, the same is true of legs 15 and 21. In the preferred embodiment of the invention, legs 13, 15 and 19, 21 are arranged at an angle of 25 degrees relative to lower support means 16 and 22. In FIG. 3, this angle is labeled $\theta$ (theta).

A series of bumpers 36 may be arranged on frame members 22 and 16 to protect walls and furniture from damage.

Figure 5:
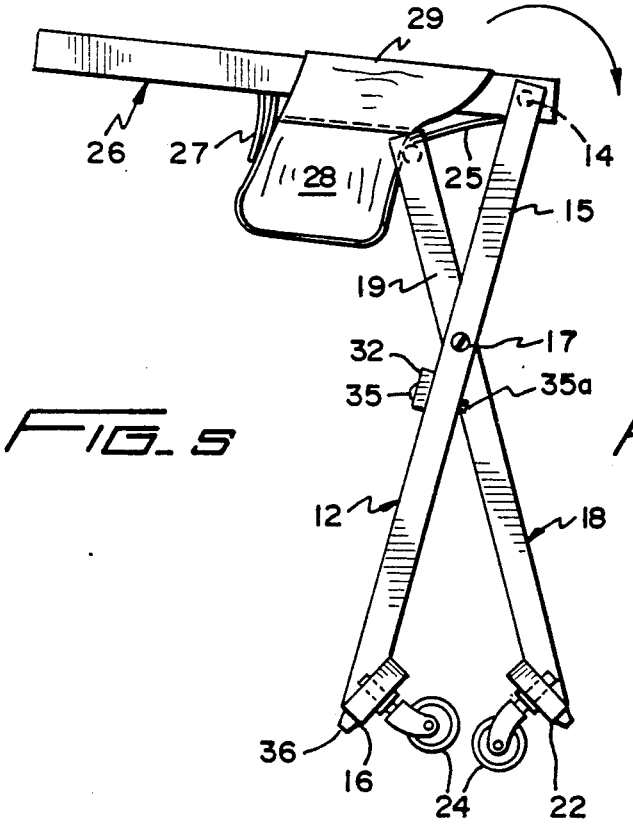
FIG. 5 is a side elevational view showing a walker partially folded.
Figure 6:
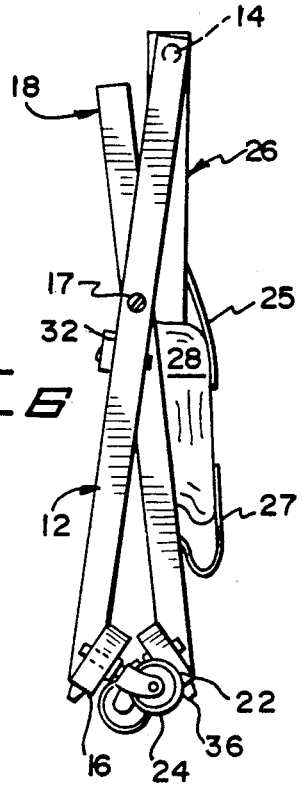
FIG. 6 is a side elevational view showing a walker completely folded.

As illustrated in FIGS. 5 and 6, walker 10 folds to the closed position for carrying or storage by lifting tray means 30 and swinging it back to pivot around upper support means 14. The user then grasps means 14 to lift said walker 10 from the floor, whereby said first and second frame members 12 and 18 pivot toward each other until lower support means 16 and 22 and upper support means 14 and 20 meet at the top and bottom of the walker, respectively. In this position, wheels 24 abut, and the walker assumes a substantially flat configuration.

While the walker of this invention may be constructed of plastic or metal, it is preferred that it be made of wood, particularly a hardwood such as oak or maple. Upper support means 14 and 20 may be dowels having their ends inserted in holes prepared therefor in frame members 12 and 18. Tray member 30 may be formed of a plastic or a material such as plywood. A pair of smaller diameter dowels 40 and 42 may secure tray 30 to frame member 26. Wheels 24 are mounted on members 16 and 22 by being inserted in hollow posts that have been secured to members 16 and 22. Protective caps of metal or hard rubber may cover the portion of these posts that protrude above the upper surface of members 16 and 22.

In its preferred embodiment, the walker of this invention, being made of wood, has an aesthetic beauty, pleasing both to the eye and to the touch, which is not attained in walkers of metal or plastic.

What is claimed is:

1. A child's walker, comprising a first frame member having a pair of arms connected to an upper support means and a lower support means, a second frame member having a pair of arms connected to an upper support means and a lower support means, said lower support means for said first and second frame members having wheel means mounted thereon, said first frame member being pivoted to said second frame member for rotation with respect to one another to thereby define an open position and a closed position, a third frame member having a flexible seat supported thereon, a rear portion of said third frame member being freely pivoted to said upper support means of said first frame member and a front portion of said third frame member being disposed across said upper support means of said second frame member and resting unsecured thereon to thereby define a horizontal plane when said first and second frame members are in said open position and supported on a floor, tray means arranged on said front portion of said third frame member, height adjusting means secured to said arms of said first frame member, said adjusting means serving to raise and lower said flexible seat relative to the floor, said adjusting means comprising a pair of blocks, each said block including an integral pin mortised thereinto and extending outward therefrom, said height adjusting means further including a threaded bolt and a nut, said integral pin and nut and bolt securing said adjusting means in place in a manner which prevents each of said blocks from swivelling out of place.

2. The walker of claim 1 wherein said walker folds to said closed position for carrying and storage by lifting said tray means and swinging it back to pivot said third frame member around said upper support means of said first support member, then grasping said upper support means to lift said walker from the floor, causing said first and second frame members to pivot toward each other until both said lower support means and said upper support means of said first and second frame members come together, said wheels abut, and the walker assumes a substantially flat configuration. frame members come together.

3. The walker of claim 1 wherein said frame members are made of hardwood.

4. A child's walker, comprising a first frame member having a pair of arms connected to an upper support means and a lower support means, a second frame member having a pair of arms connected to an upper support means and a lower support means, said lower support means mounted thereon, said first frame member being pivoted to said second frame member for rotation with respect to one another to thereby define an open position and a closed position, a third frame member having a flexible seat supported thereon, a rear portion of said third frame member being freely pivoted to said upper support means of said first frame member and a front portion of said third frame member being disposed across said upper support means of said second frame member and resting unsecured thereon to thereby define a horizontal plane when said first and second frame members are in said open position and supported on a floor, said flexible seat being formed of three portions of flexible material, said three portions being freely movable on said third frame member, tray means arranged on said front portion of said third frame member, height adjusting means secured to said arms of said first frame member, said adjusting means serving to raise and lower said flexible seat relative to the floor, said adjusting means comprising a pair of blocks, each said block including an integral pin mortised thereinto and extending outward therefrom, said height adjusting means further including a threaded bolt and a nut, said integral pin and nut and bolt securing said adjusting means in place in a manner which prevents said blocks from swiveling out of place, said walker folding to said closed position for carrying and storage by lifting said unsecured tray means and swinging it back to pivot said third frame member around said upper support means of said first support member, then grasping said upper support means to lift said walker from the floor, causing said first and second frame members to pivot toward each other until both said lower support means and said upper support means of said first and second frame members come together, said wheels abut, and said walker assumes a substantially flat configuration.

5. The walker of claim 4 wherein said arms of said first and second frame members angle upward from said lower support means at an angle $\theta$ (theta), and further wherein said angle is 25 degrees.

6. The walker of claim 4 wherein said frame members are made of hardwood.

* * * * *